US009360826B2

(12) United States Patent
Saito et al.

(10) Patent No.: US 9,360,826 B2
(45) Date of Patent: Jun. 7, 2016

(54) LUBRICATION DEVICE AND IMAGE FORMING APPARATUS INCORPORATING SAME

(71) Applicants: Tomohiko Saito, Kanagawa (JP); Fumihito Itoh, Miyagi (JP); Toshiya Sato, Kanagawa (JP); Norio Kudoh, Kanagawa (JP); Hiroyuki Uenishi, Kanagawa (JP)

(72) Inventors: Tomohiko Saito, Kanagawa (JP); Fumihito Itoh, Miyagi (JP); Toshiya Sato, Kanagawa (JP); Norio Kudoh, Kanagawa (JP); Hiroyuki Uenishi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/548,968

(22) Filed: Nov. 20, 2014

(65) Prior Publication Data

US 2015/0160600 A1 Jun. 11, 2015

(30) Foreign Application Priority Data

Dec. 9, 2013 (JP) ..... 2013-253898
Mar. 12, 2014 (JP) ..... 2014-049059
May 14, 2014 (JP) ..... 2014-100174

(51) Int. Cl.
*G03G 21/00* (2006.01)
*G03G 15/00* (2006.01)

(52) U.S. Cl.
CPC ..... *G03G 21/0094* (2013.01); *G03G 15/757* (2013.01)

(58) Field of Classification Search
CPC ..... G03G 21/0011; G03G 21/0094; G03G 15/50; G03G 15/757
USPC ..... 399/43, 346, 167
See application file for complete search history.

(56) References Cited

U.S. PATENT DOCUMENTS

| | | | | |
|---|---|---|---|---|
| 2008/0069614 | A1* | 3/2008 | Shintani et al. | 399/346 |
| 2009/0241830 | A1 | 10/2009 | Koike et al. | |
| 2010/0080602 | A1* | 4/2010 | Taguma | 399/346 |
| 2010/0183349 | A1 | 7/2010 | Shintani et al. | |
| 2011/0064433 | A1 | 3/2011 | Asaoka et al. | |
| 2012/0315053 | A1 | 12/2012 | Kudo et al. | |
| 2012/0321330 | A1 | 12/2012 | Kudo et al. | |
| 2014/0093295 | A1 | 4/2014 | Kojima et al. | |
| 2014/0126942 | A1 | 5/2014 | Kojima et al. | |
| 2014/0233997 | A1 | 8/2014 | Asaoka et al. | |

FOREIGN PATENT DOCUMENTS

| | | |
|---|---|---|
| JP | 2010-164831 | 7/2010 |
| JP | 2011-102946 | 5/2011 |
| JP | 2012-155267 | 8/2012 |
| JP | 2013-105137 | 5/2013 |

* cited by examiner

*Primary Examiner* — Hoang Ngo
(74) *Attorney, Agent, or Firm* — Harness, Dickey & Pierce PLC

(57) ABSTRACT

An image forming apparatus includes an image bearer; a toner image forming unit to form a toner image on the image bearer; a transfer device to transfer the toner image from the image bearer onto a transfer medium; a cleaning device to remove untransferred toner from the image bearer; and a lubrication device including a solid lubricant, an applicator to apply lubricant scraped off from the solid lubricant to the image bearer while rotating, and an applicator driving device to rotate the applicator; and a controller to control the applicator driving device according to a predetermined variable to change a rotational frequency of the applicator during idle running of the image bearer.

17 Claims, 7 Drawing Sheets

LUBRICATION DEVICE AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application Nos. 2013-253898 filed on Dec. 9, 2013, 2014-049059 filed on Mar. 12, 2014, and 2014-100174 filed on May 14, 2014, in the Japan Patent Office, the entire disclosure of each of which is hereby incorporated by reference herein.

BACKGROUND

1. Technical Field

Embodiments of the present invention generally relate to a lubrication device and an image forming apparatus, such as, a copier, a printer, a facsimile machine, a plotter, or a multi-function peripheral (MFP) including at least two of copying, printing, facsimile transmission, plotting, and scanning capabilities, that includes the lubrication device.

2. Description of the Related Art

In electrophotographic image forming apparatuses, typically, after toner images are transferred from an image bearer onto an intermediate transfer member or sheets of recording media, a certain amount of toner is not transferred but remains on a surface of the image bearer. Such toner is hereinafter referred to as "untransferred toner". To inhibit adverse effects of untransferred toner on subsequent image formation, image forming apparatuses usually include a cleaning device to remove the untransferred toner from the surface of the image bearer. Cleaning devices widely used include a cleaner, such as a cleaning blade or a cleaning brush, which slidingly contacts the surface of the image bearer to remove the untransferred toner from the image bearer. In such a cleaning device, when the cleaner is used for a long time and wears significantly, the cleaner chips or deforms. Then, the possibility of inconveniences, such as degradation of cleaning capability, increases. If the surface of the image bearer ears significantly, the operational life thereof is shortened.

To reduce frictional resistance between the surface of the image bearer and a component to contact the image bearer, typically the surface of the image bearer is lubricated. Since the lubrication of the image bearer reduces the frictional resistance between the cleaner and the surface of the image bearer, wear of the cleaner and the image bearer and inconveniences caused thereby are suppressed. Additionally, compared with pulverized toner, it is more difficult for a cleaning blade to remove spherical polymerization toner, which is widely used currently. The lubricant on the image bearer reduces adhesive force of the polymerization toner adhering to the surface of the image bearer. Accordingly, the surface of the image bearer is lubricated to facilitate removal of polymerization toner from the surface of the image bearer by the cleaning blade.

Additionally, in a portion where the cleaner contacts the image bearer, it is possible that plasticizer, charge controlling agent, and the like externally added to toner firmly adhere to the image bearer in a shape of film, which is a phenomenon called filming. The occurrence of filming can be inhibited by lubricating the image bearer. Additionally, it is known that, typically, the surface of the image bearer is easily degraded when a charging bias including an alternating voltage (current) component is applied thereto. The lubricant on the surface of the image bearer can suppress such degradation of the surface of the image bearer.

Although lubrication of the surface of the image bearer thus attains various effects, the effect is not sufficient if the amount of lubricant applied thereto is excessive or insufficient. If the amount of lubricant applied is insufficient, the amount of lubricant adhering to the surface of the image bearer tends to be insufficient locally. Portions where the amount of lubricant is insufficient can cause wear of the cleaner and the image bearer, hinder cleaning, or degrade the surface of the image bearer.

By contrast, if the amount of lubricant applied is excessive, it is possible that lubricant excessively adheres to a component such as a charging roller that contacts or approaches the image bearer, thus degrading capability of that component. Additionally, under humid conditions, excessive lubricant on the image bearer absorbs moisture and exhibits conductivity. Then, there arises a risk that electrostatic latent images are disturbed, resulting in image failure such as image deletion and image blurring.

SUMMARY

An embodiment of the present invention provides an image forming apparatus that includes an image bearer, a toner image forming unit to form a toner image on the image bearer, a transfer device to transfer the toner image from the image bearer onto a transfer medium, a cleaning device to remove untransferred toner from the image bearer, a lubrication device to apply lubricant to the image bearer, and a controller. The lubrication device includes a solid lubricant, an applicator to apply lubricant scraped off from the solid lubricant to the image bearer while rotating, and an applicator driving device to rotate the applicator. The controller controls the applicator driving device according to a predetermined variable to change a rotational frequency of the applicator during idle running of the image bearer.

Another embodiment provides a lubrication device that includes a solid lubricant, an applicator to apply lubricant scraped off from the solid lubricant to an image bearer while rotating, and an applicator driving device to rotate the applicator. A setting of the applicator driving device is changed according to a predetermined variable to change a rotational frequency of the applicator during idle running of the image bearer.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
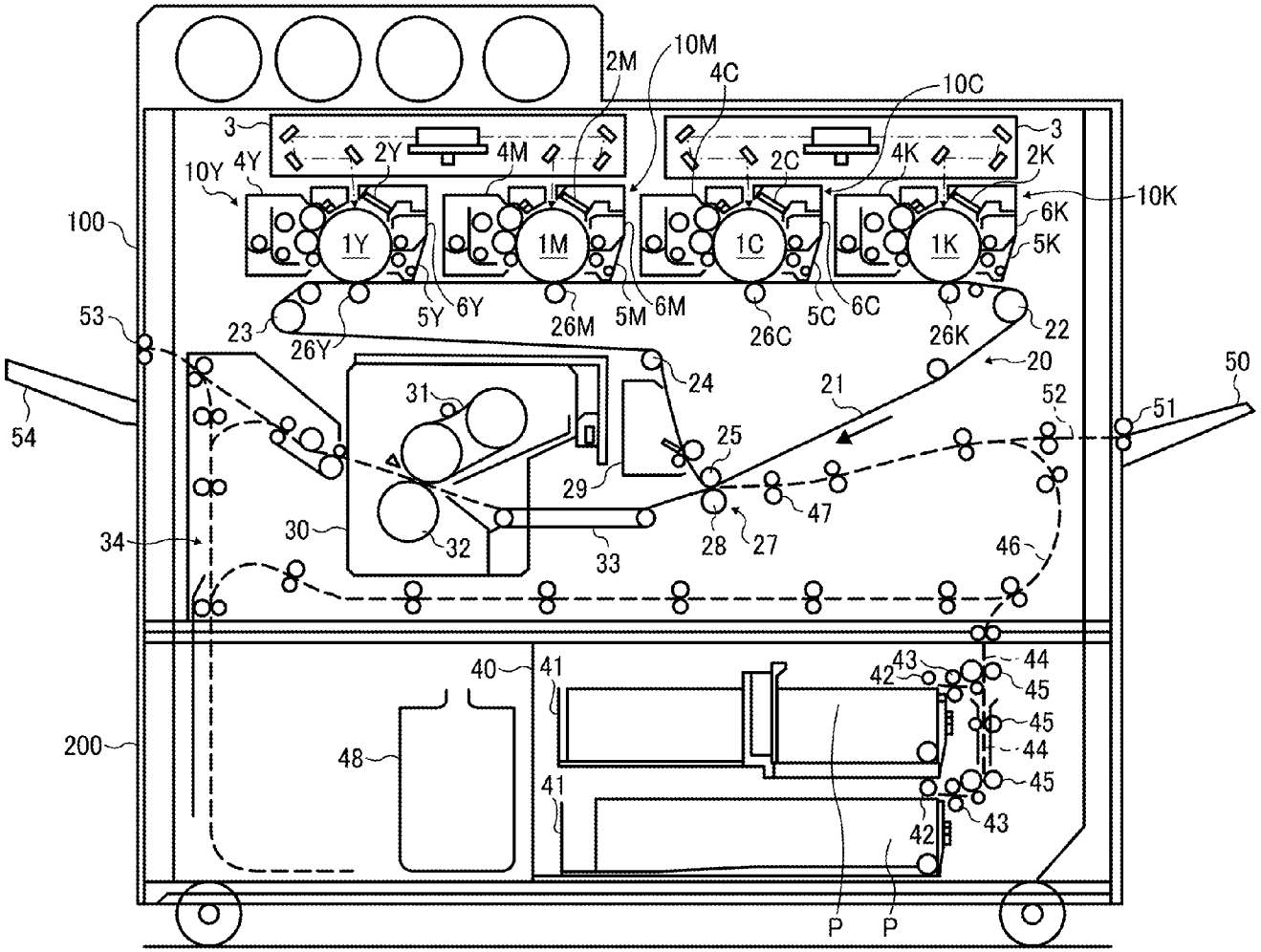
FIG. 1 is a schematic diagram of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a configuration and operation of an image forming apparatus that is common to multiple embodiments of the present invention are described below.

FIG. 1 is a schematic diagram of an image forming apparatus 1000, which is a tandem image forming apparatus of intermediate transfer type, for example.

The image forming apparatus 1000 shown in FIG. 1 includes an apparatus body 100 to perform image formation and a sheet feeder 200 to feed sheets P of recording media to the apparatus body 100. The apparatus body 100 includes four image forming units 10Y, 10M, 10C, and 10K to form yellow (Y), magenta (M), cyan (C), and black (K) images, respectively.

It is to be noted that suffixes Y, M, C, and K may be omitted when color discrimination is not necessary. The image forming units 10Y, 10M, 10C, and 10K respectively include photoconductors 1Y, 1M, 1C, and 1K as image bearer to bear respective color toner images. Around each photoconductor 1, a charging device 2 that charges a surface of the photoconductor 1 uniformly and a developing device 4 that develops an electrostatic latent image on the photoconductor 1 into a toner image are provided. Additionally, a cleaning device 5 and a lubrication device 6 are disposed around the photoconductor 1. The cleaning device 5 cleans the surface of the photoconductor 1 after the toner image is transferred therefrom. The lubrication device 6 applies lubricant to the surface of the photoconductor 1.

Above the image forming units 10Y, 10M, 10C, and 10K, an optical writing unit 3 is disposed. The optical writing unit 3 irradiates the uniformly charged surfaces of the photoconductors 1Y, 1M, 1C, and 1K with laser beams according to image data, thereby forming electrostatic latent images. The optical writing unit 3 includes a laser light source, a polygon mirror, an f-O lens, reflection minors, and the like. While the photoconductors 1Y, 1M, 1C, and 1K are rotated, the optical writing unit 3 irradiates and scans the surfaces of the photoconductors 1Y, 1M, 1C, and 1K with the laser beams in a main scanning direction according to the image data.

A transfer unit 20 disposed beneath the image forming units 10Y, 10M, 10C, and 10K transfers the toner images from the photoconductors 1Y, 1M, 1C, and 1K via an intermediate transfer belt 21 onto the sheet P. The intermediate transfer belt 21 is, for example, an endless belt, looped around multiple rollers including a driving roller 22 and support rollers 23, 24, and 25, and rotated counterclockwise in FIG. 1 at a predetermined timing. Primary-transfer rollers 26Y, 26M, 26C, and 26K are disposed inside the loop of the intermediate transfer belt 21 and apply transfer electrical charges to the photoconductors 1 at primary-transfer positions, thereby primarily transferring the toner images from the photoconductors 1Y, 1M, 1C, and 1K onto the intermediate transfer belt 21.

The transfer unit 20 further includes a secondary-transfer device 27 on the side opposite the image forming units 10 across the intermediate transfer belt 21. The secondary-transfer device 27 presses a secondary-transfer roller 28 against a secondary-transfer backup roller 25 via the intermediate transfer belt 21 and applies a transfer electrical field thereto, thereby transferring the toner image from the intermediate transfer belt 21 onto the sheet P. Additionally, the transfer unit 20 includes a belt cleaning device 29 situated between the support roller 24 and the secondary-transfer backup roller 25. The transfer unit 20 removes toner remaining on the intermediate transfer belt 21 after the toner image is transferred therefrom onto the sheet P.

On the left of the transfer unit 20 in FIG. 1, a fixing device 30 to fix the toner image on the sheet P is provided. The fixing device 30 presses a pressure roller 32 against a fixing belt 31 and fixes the toner image on the sheet P with heat and pressure. Additionally, a conveyance belt 33 is provided between the secondary-transfer device 27 and the fixing device 30 to transport the sheet P from a secondary-transfer position to the fixing device 30. A sheet reversal unit 34 is provided beneath the transfer unit 20 and parallel to the image forming units 10Y, 10M, 10C, and 10K. The sheet reversal unit 34 reverses the sheet P upside down to form images on both sides of the sheet P.

The sheet feeder 200 shown in FIG. 1 includes multiple sheet feeding trays 41 arranged vertically in a paper bank 40. A bundle of sheets P is stacked on each sheet feeding tray 41, and a sheet feeding roller 42 presses against a top sheet on the sheet feeding tray 41. When one of the sheet feeding rollers 42 selected rotates, the sheets P are fed to a sheet feeding path 44 one by one, separated by a separation roller 43. The sheet P is transported by multiple pairs of conveyance rollers 45 through the sheet feeding path 44 to a sheet feeding path 46 inside the apparatus body 100 and gets stuck in a nip between registration rollers 47. The registration rollers 47 stop rotating immediately after the sheet P is sandwiched therebetween and then forward the sheet P to the secondary-transfer device 27 timed to coincide with image formation.

The image forming apparatus 1000 forms images as follows. For example, in the image forming unit 10Y to form yellow images, the optical writing unit 3 directs the laser beam, which is modulated and deflected, to the surface of the photoconductor 1Y charged uniformly by the charging device 2Y. Thus, an electrostatic latent image is formed. Then, the developing device 4Y develops the electrostatic latent image on the photoconductor 1Y into a yellow toner image. At the primary-transfer position facing the primary-transfer roller 26 via the intermediate transfer belt 21, the toner image is transferred from the photoconductor 1Y onto the intermediate transfer belt 21.

After the toner image is transferred therefrom, the surface of the photoconductor 1Y is cleaned by the cleaning device 5 and lubricated by the lubrication device 6Y as a preparation for subsequent formation of electrostatic latent images. The toner thus removed (i.e., waste toner) is discharged to a waste-toner bottle 48 through a conveyance channel by a conveying screw of the cleaning device 5.

In other image forming units 10M, 10C, and 10K, the above-described image forming processes are executed in synchronization with conveyance of sheets by the intermediate transfer belt 21. Meanwhile, the sheet P fed from the sheet feeding tray 41 is forwarded to the secondary-transfer position by the registration rollers 47 at a predetermined timing. Alternatively, the sheet P is fed from a bypass tray 50 on a side of the apparatus body 100 by a sheet feeding roller 51 to a bypass path 52, and then forwarded to the secondary-transfer device 27 by the registration rollers 47 at a predetermined timing. Then, a full-color image is transferred by the secondary-transfer device 27 onto the sheet P. The sheet P is transported by the conveyance belt 33 to the fixing device 30, where the toner image is fixed, and discharged onto a paper ejection tray 54 by a pair of ejection rollers 53.

Alternatively, a switching pawl switches the route in which the sheet P carrying the fixed toner image is transported to the sheet reversal unit 34, and the sheet P is again transported to the secondary-transfer device 27. Then, a toner image is recorded on a back side of the sheet P, after which the sheet P is discharged onto the paper ejection tray 54 by the ejection rollers 53. Meanwhile, the belt cleaning device 29 removes toner remaining on the intermediate transfer belt 21 after the toner image is transferred therefrom as a preparation for subsequent image formation by the image forming units 10. The toner thus removed (i.e., waste toner) is discharged to the waste-toner bottle 48 through a conveyance channel by a conveying screw of the belt cleaning device 29.

The operation described above is executed when a full-color mode (or a multicolor mode) in which four single-color images are superimposed one on another is selected on a control panel. For example, when monochrome mode (or a single-color mode) is selected on the control panel, the support rollers 23, 24, and 25 except the driving roller 22 may be moved to disengage the photoconductors 1Y, 1M, and 1C from the intermediate transfer belt 21, and only a black toner image is formed on the intermediate transfer belt 21.

Figure 2:
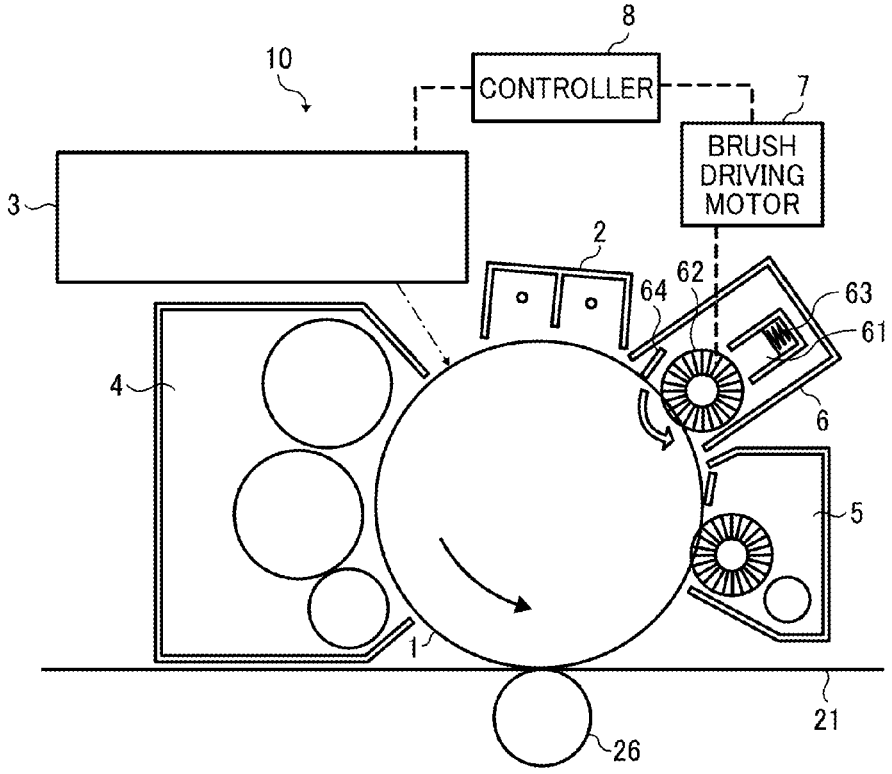
FIG. 2 is an enlarged view illustrating a configuration of one of multiple image forming units of the image forming apparatus shown in FIG. 1.

FIG. 2 is an enlarged view illustrating a configuration of one of the image forming units 10. It is to be noted that image forming units 10 have a similar configuration except the color of toner used therein, and hereinafter the suffixes Y, M, C, and K are omitted in the drawings and specification.

As shown in FIG. 2, as the image forming unit 10 according to the present embodiment, the photoconductor 1, the charging device 2, the developing device 4, and the cleaning device 5 are united into a process cartridge (i.e., a modular unit) removably installable in the apparatus body 100.

Additionally, in the image forming unit 10 according to the present embodiment, the cleaning device 5 may be integrated with the lubrication device 6 as schematically shown in FIG. 1. Alternatively, the photoconductor 1, the charging device 2, the developing device 4, the cleaning device 5, and the lubrication device 6 may be independently replaced after the image forming unit 10 is removed from the apparatus body 100.

Descriptions are given below of configurations and operations of the lubrication device 6.

(First Embodiment)

The lubrication device 6 according to a first embodiment is described below.

As shown in FIG. 2, the lubrication device 6 includes a bar-shaped solid lubricant 61 (i.e., a block of lubricant) and a brush roller 62 serving as an applicator to apply lubricant to the image bearer. The brush roller 62 includes brush fibers disposed at the circumference of the brush roller 62 to slidingly contact both of the solid lubricant 61 and the photoconductor 1. The lubrication device 6 further includes a compression spring 63 as a bias member to bias the solid lubricant 61 to the brush roller 62. The bias member is not limited to the compression spring 63. For example, a weight of the solid lubricant 61 itself or a load of a weight may be used. While rotating counterclockwise in FIG. 2, the brush roller 62 slidingly contacts the solid lubricant 61 biased by the compression spring 63, and rubs away powdered lubricant from the solid lubricant 61 with the brush fibers. The brush fibers also contact the photoconductor 1 rotating counterclockwise in FIG. 2, and thus the brush roller 62 applies the lubricant to the photoconductor 1.

It is to be noted that in the configuration in which the photoconductor 1 is lubricated by the brush roller 62, powdered lubricant is applied onto the surface of the photoconductor 1, and it is possible that the lubricant being the powdered state does not fully exert lubricity. Therefore, it is preferable that a leveling blade 64, serving as a leveler to level off lubricant, be disposed downstream from the brush roller 62 in the direction in which the photoconductor 1 rotates.

For the solid lubricant 61, known materials such as zinc stearate can be used as long as sufficient lubricity is exerted without adverse effects. Zinc stearate is a typical lamellar crystal powder. Lamellar crystals have a layer structure including self-organization of an amphiphilic molecule, and the crystal is broken easily along junctures between layers and becomes slippery receiving shearing force. That is, the surface of the photoconductor 1 can be coated effectively with lubricant by lamellar crystals that uniformly cover the surface of the photoconductor 1 upon shearing force. Accordingly, friction on the surface of the photoconductor 1 can be reduced with a small amount of lubricant.

In addition to zinc stearate, materials usable for the solid lubricant 61 include those including a stearate group, namely, barium stearate, iron stearate, nickel stearate, cobalt stearate, stearate copper, strontium stearate, calcium stearate, and the like.

In addition, compounds including an identical fatty acid group, such as, zinc oleate, barium oleate, manganese oleate, iron oleate, cobalt oleate, zinc palmitate, cobalt palmitate, copper palmitate, magnesium palmitate, aluminum palmitate, and calcium palmitate, can be used.

Also used for lubricant are those including caprylic acid, caproic acid, or linolenic acid; and natural wax such as carnauba wax.

The brush roller 62 is driven by a brush driving motor 7, serving as an applicator driving device, that is a variable speed motor in the present embodiment. A controller 8 to control the brush driving motor 7 adjusts the frequency of rotation (hereinafter "rotational frequency R") of the brush driving motor 7 according to a predetermined variable during idle running of the photoconductor 1. The predetermined variable includes a toner input amount and a lubrication capability. The toner input amount can be an image area ratio that is an area ratio of toner images in an image formation area on the photoconductor 1. The lubrication capability can be a cumulative number of rotation or a cumulative driving time of the brush roller 62.

When the toner input amount, such as the image area ratio on the photoconductor 1, changes, the amount of lubricant supplied to the photoconductor 1 fluctuates. When the toner input amount is zero or smaller than a preferred amount, the lubricant supplied to the surface of the photoconductor 1 is not consumed but accumulates on the photoconductor 1. Then, the amount of lubricant becomes excessive. By contrast, when the toner input amount is larger, the lubricant is transferred from the photoconductor 1 together with the toner image by the primary-transfer roller 26 or the like, and the amount of lubricant on the photoconductor 1 becomes insufficient.

Figure 3:
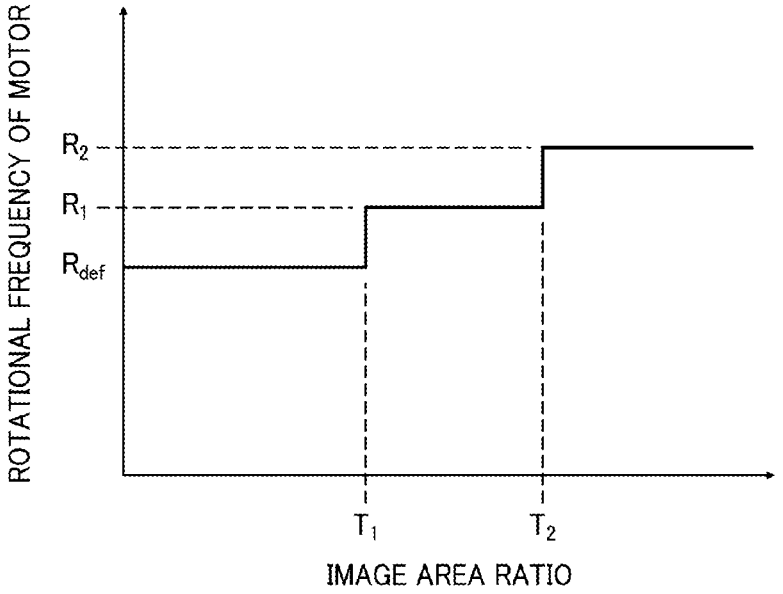
FIG. 3 is a graph illustrating the relation between an image area ratio and a frequency of rotation of a brush driving motor according to a first embodiment.

In view of the foregoing, as the image area ratio increases, the controller 8 switches the rotational frequency R of the brush driving motor 7 to increase the frequency of rotation of the brush roller 62, thereby increasing the amount of lubricant applied to the photoconductor 1. That is, the controller 8 controls the brush driving motor 7 to change the frequency of rotation of the brush roller 62. Specifically, as shown in FIG. 3, the controller 8 sets the rotational frequency R of the brush driving motor 7 to $R_{def}$ when the image area ratio is less than a first threshold $T_1$. In the configuration shown in FIG. 3, when the image area ratio is at or greater than the first threshold $T_1$ and less than a second threshold $T_2$, the rotational frequency R of the brush driving motor 7 is set to $R_1$. When the image area ratio is at or greater than the second threshold $T_2$, the rotational frequency R of the brush driving motor 7 is set to $R_2$. With this control, the amount of lubricant applied can corresponds to the image area ratio on the photoconductor 1.

It is to be noted that the image area ratio can be calculated based on the image data according to which the optical writing unit 3 forms electrostatic latent images on the photoconductor 1. The controller 8 can perform similar control operations when the number of thresholds of the image area ratio is three or greater.

If meshing of gears used for the driving device such as the brush driving motor 7 to drive the applicator such as the brush roller 62 is not smooth, the applicator can vibrate when the rotational frequency of the driving device is changed to change the rotational frequency of the applicator. The applicator and the image bearer are often driven by a common drive source. In this case, the vibration is transmitted to the image bearer, and the rotation of the image bearer becomes uneven. Thus, if the rotational frequency of the applicator is changed during printing operation, there is a risk of image failure such as banding that is density unevenness caused by meshing pitches of gears.

Figure 4:
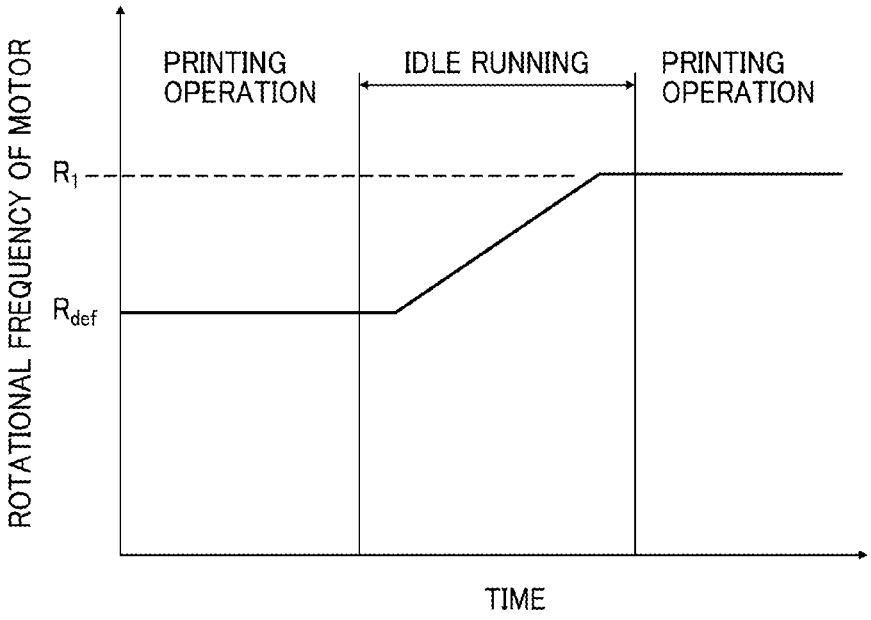
FIG. 4 is a graph illustrating the relation between operation of the image forming apparatus and the frequency of rotation of the brush driving motor according to the first embodiment.

Referring to FIG. 4, switching of the rotational frequency R of the brush driving motor 7 is executed during idle running of the photoconductor 1. The term "idle running" used here means a state in which all motors used for printing operate similar to printing operation, but exposure by the optical writing unit 3 is stopped, thus suspending the printing operation. Switching the rotational frequency R of the brush driving motor 7 during the idle running, in which printing is not performed, is advantageous in inhibiting the occurrence of image failure, such as banding, caused by the switching of the rotational frequency R.

Figure 5:
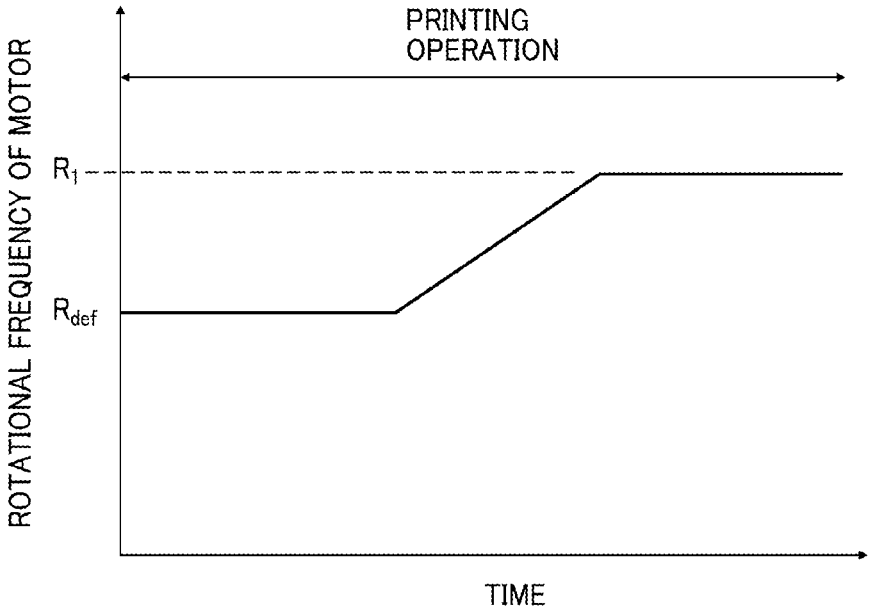
FIG. 5 is a graph illustrating the relation between operation of an image forming apparatus and a frequency of rotation of a brush driving motor according to a comparative example.

By contrast, FIG. 5 illustrates a comparative example of control of the brush driving motor 7. If the rotational frequency R of the brush driving motor 7 is switched during printing operation as shown in FIG. 5, the brush roller 62 or the photoconductor 1 can vibrate, causing image failure such as banding.

It is to be noted that efficiencies in image formation is degraded if the duration of idle running is excessively long. It is preferred that the duration of idle running be not longer than a duration sufficient to stabilize rotation of the photoconductor 1 after the rotational frequency R of the brush driving motor 7 is switched.

Additionally, the predetermined variable according to which the brush driving motor 7 is controlled is not limited to the toner input amount such as the image area ratio of the toner image formed on the photoconductor 1. Alternatively, the rotational frequency R of the brush roller 62 may be adjusted according to changes in lubrication capability defined by the cumulative number of rotation or the cumulative driving time of the brush roller 62, or the like. For example, as the cumulative number of rotation of the brush roller 62 increases, the controller 8 switches the rotational frequency R of the brush driving motor 7 to increase the frequency of rotation of the brush roller 62, thereby increasing the amount of lubricant applied to the photoconductor 1.

Alternatively, as the cumulative driving time of the brush roller 62 increases, the controller 8 switches the rotational frequency R of the brush driving motor 7 to increase the frequency of rotation of the brush roller 62, thereby increasing the amount of lubricant applied to the photoconductor 1. As the cumulative number of rotation or the cumulative driving time of the brush roller 62 increases, the brush fibers of the brush roller 62 wear, and the lubrication capability is degraded. In the present embodiment, since the controller 8 adjusts the rotational frequency R of the brush driving motor 7 to increase the frequency of rotation of the brush roller 62 as the lubrication capability of the brush roller 62 is degraded, the preferable amount of lubricant can be supplied to the photoconductor 1.

Alternatively, the controller 8 may determine the rotational frequency R based on not a single variable but a combination of variables. Then, a more preferable amount of lubricant can be applied to the photoconductor 1. In either case, switching the rotational frequency R of the brush driving motor 7 during idle running of the photoconductor 1 is advantageous in inhibiting the occurrence of image failure, such as banding, caused by the switching of the rotational frequency R.

In the present embodiment, the variable according to which the rotational frequency of the applicator is changed is not the rotational frequency of the image bearer, and the rotational frequency of the applicator is can be changed while the rotational frequency of the image bearer is kept constant.

(Second Embodiment)

The lubrication device 6 according to a second embodiment is described below.

Figure 6A:
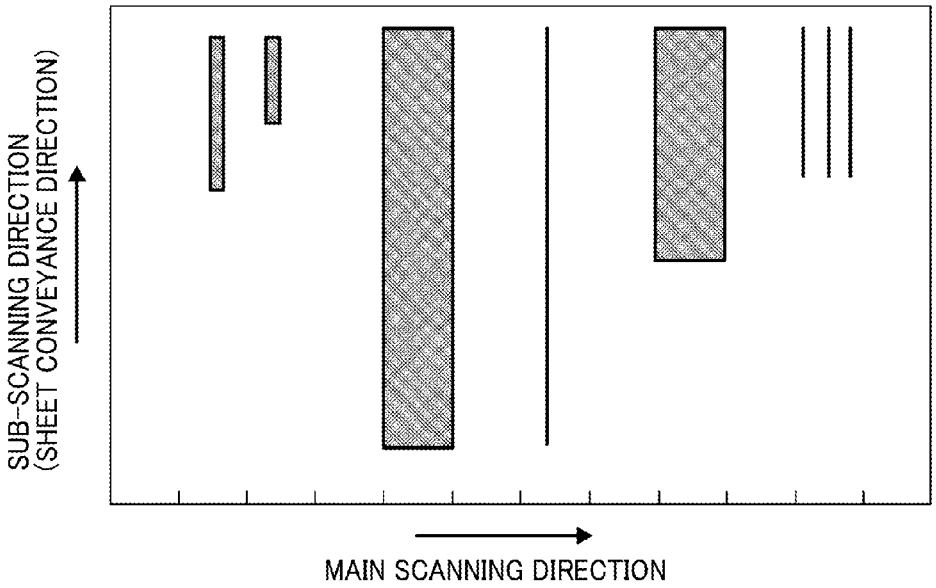
FIG. 6A is an example toner image having different image area ratios among multiple ranges divided in a main scanning direction, according to a second embodiment.
Figure 6B:
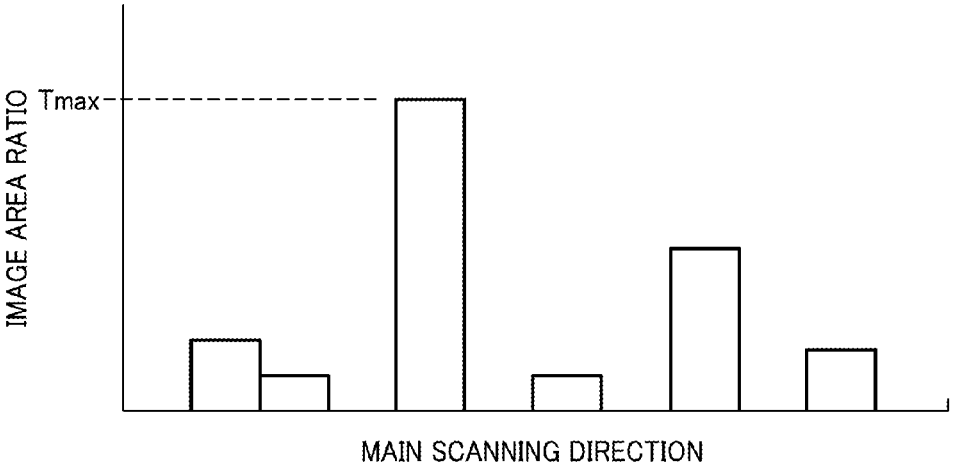
FIG. 6B is a graph of image area ratios in respective divided ranges shown in FIG. 6A.

Referring to FIGS. 6A and 6B, descriptions are given below of differences in image area ratio in multiple ranges divided in the main scanning direction. FIG. 6A is an example toner image formed on the photoconductor 1, and FIG. 6B is a graph of image area ratios in the respective ranges shown in FIG. 6A.

Differently from the above-described first embodiment, in the lubrication device 6 according to the present embodiment, the image area ratio is obtained for each of multiple ranges of the toner image on the photoconductor 1 divided in the main scanning direction, and the brush driving motor 7 is controlled according to the image area ratio using the image area ratio of the divided range. Other than that, the second embodiment is similar to the first embodiment.

Accordingly, descriptions about configurations, operation, action, and effects of the present embodiment similar to those of the first embodiment are omitted. Components identical or similar to those described above are given identical reference characters.

In the lubrication device 6 according to the first embodiment, the brush driving motor 7 is controlled according to, as the image area ratio, the area ratio of the toner image to the entire image formation area on the photoconductor 1 (hereinafter "mean image area ratio").

In typical image forming apparatuses, however, the mean image area ratio of the toner image on the photoconductor 1 changes during printing operation, and it is possible that the mean image area ratio changes sharply during printing operation. Additionally, the area ratio of the toner image per unit area (hereinafter "unit image area ratio") often differs greatly in the main scanning direction. For example, when a portion of the image formation area in the main scanning direction has an image whose unit image area ratio in the sub-scanning direction is higher, the mean image area ratio is low, but the unit image area ratio is higher in that portion. Accordingly, the amount of lubricant applied becomes insufficient locally. In such a portion, there is a risk of image failure in which toner is partly absent or filming occurs locally.

For example, when the toner image shown in FIG. 6A is formed on the photoconductor 1, the image area ratio in each of the multiple ranges on the photoconductor 1 divided in the main scanning direction is as shown in FIG. 6B.

Therefore, in the lubrication device 6 according to the present embodiment, the image area ratio is obtained for each of the multiple ranges on the photoconductor 1 divided in the main scanning direction, and the controller 8 controls the brush driving motor 7 using the image area ratio of one or more of the divided ranges.

With this control operation, the preferable amount of lubricant can be applied to the photoconductor 1 even when the unit image area ratio is higher in a given portion on the photoconductor 1.

Specifically, in the lubrication device 6 according to the present embodiment, the image area ratio is calculated in each of the multiple ranges on the photoconductor 1 divided in the main scanning direction, and the controller 8 controls the brush driving motor 7 using the largest (i.e., a largest value Tmax) of the respective image area ratios of the multiple ranges.

The following effects are available by controlling the brush driving motor 7 according to the image area ratio of the range having the largest image area ratio among the multiple ranges on the photoconductor 1 divided in the main scanning direction. Even when the unit image area ratio is high locally on the photoconductor 1, the preferable amount of lubricant can be applied to the photoconductor 1. Simultaneously, calculation steps of the controller 8 to control the brush driving motor 7 are simplified.

It is to be noted that aspects of the present specification are not limited to the description above in which the brush driving motor 7 is controlled according to the image area ratio of the range having the largest image area ratio among the multiple ranges on the photoconductor 1 divided in the main scanning direction. For example, not one but two or more highest image area ratios may be selected from the image area ratios of the multiple ranges, and the brush driving motor 7 may be controlled according a mean value of the highest image area ratios.

Additionally, similar to the first embodiment, the controller 8 may determine the rotational frequency R based on not a single variable but a combination of variables. Then, a more preferable amount of lubricant can be applied to the photoconductor 1. In either case, switching the rotational frequency R of the brush driving motor 7 during idle running of the photoconductor 1 is advantageous in inhibiting the occurrence of image failure, such as banding, caused by the switching of the rotational frequency R.

(Third Embodiment)

The lubrication device 6 according to a third embodiment is described below.

Figure 7:
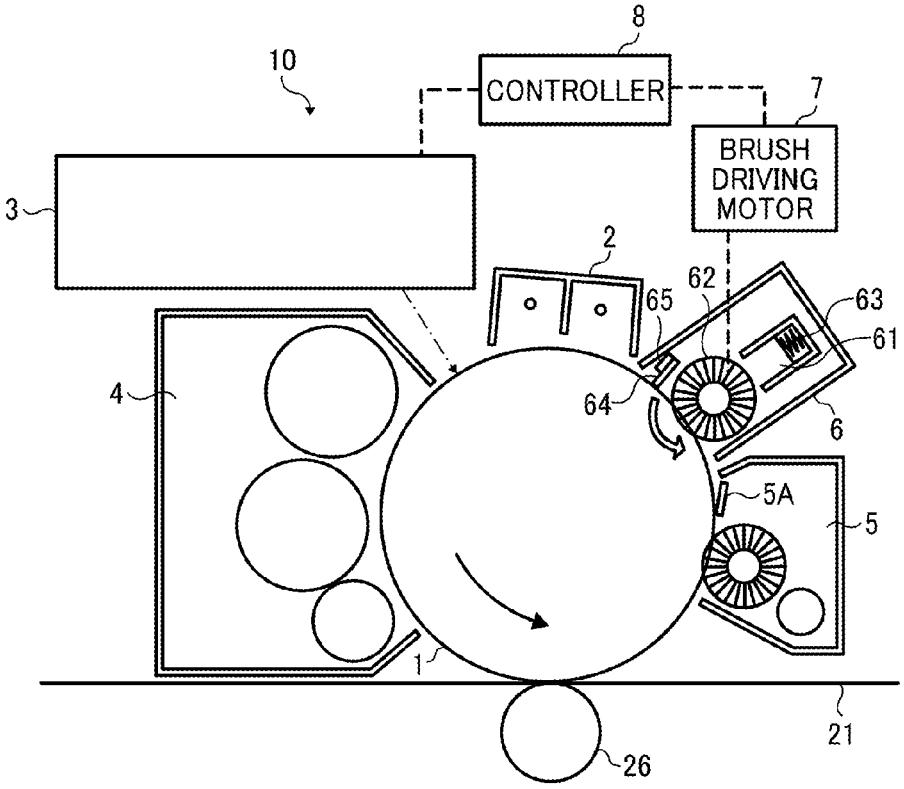
FIG. 7 is an enlarged view illustrating a configuration of an image forming unit according to a third embodiment.
Figure 8:
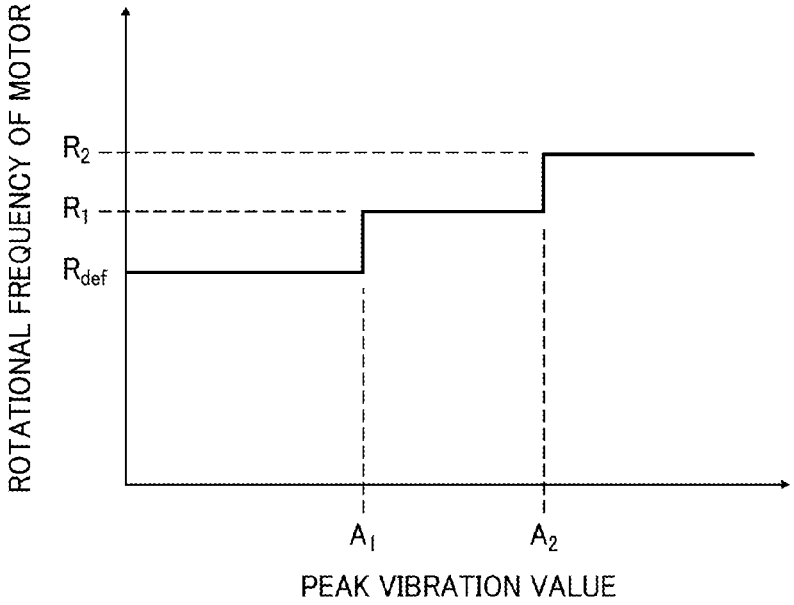
FIG. 8 is a graph illustrating the relation between a peak value of vibration detected by a vibration detector and the rotational frequency of the brush driving motor according to the third embodiment.
Figure 9:
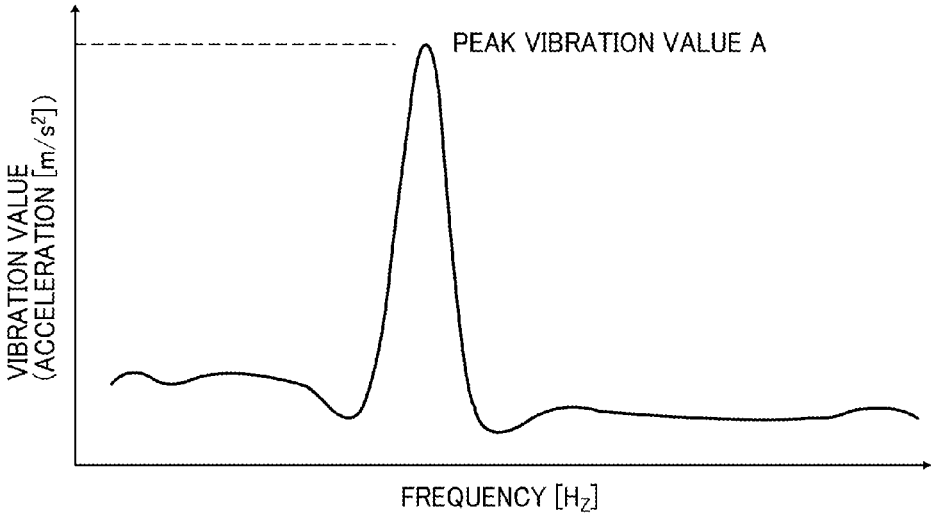
FIG. 9 is a graph illustrating the relation between a frequency component of vibration detected by the vibration detector and the peak value of the vibration according to the third embodiment.

FIG. 7 is an enlarged view illustrating a configuration of the image forming unit 10 according to the present embodiment. FIG. 8 is a graph illustrating the relation between a peak value of vibration detected by a vibration detector 65 and the rotational frequency R of the brush driving motor 7. FIG. 9 is a graph illustrating the relation between a frequency component of vibration detected by the vibration detector 65 and the peak value of the vibration.

The lubrication device 6 according to the present embodiment is different from those of the above-described first and second embodiments in the predetermined variable used by the controller 8 to control the rotational frequency R of the brush driving motor 7. Specifically, in contrast to the first and second embodiments in which the mean image area ratio or the image area ratio of the divided range is used as the predetermined variable, vibration of the lubrication device 6 is used as the predetermined variable in the present embodiment.

Accordingly, descriptions about configurations, operation, action, and effects of the present embodiment similar to those of the first or second embodiment are omitted. Components identical or similar to those described above are given identical reference characters.

As described above, in the first and second embodiments, the controller 8 controls the brush driving motor 7 using the mean image area ratio of toner images on the photoconductor 1 or the image area ratio of at least one of the divided ranges on the photoconductor 1.

As described in the second embodiment, when the mean image area ratio is used, for example, in the case shown in FIG. 6A, in which the image area ratio entirely is low but the image area ratio is high locally, there is a risk of shortage of lubricant. In other words, there is a risk of shortage of lubricant in a case of a toner image having ranges different in image area ratio.

When lubricant is insufficient, friction coefficient between the photoconductor 1 and the leveling blade 64 rises, and it is possible that the leveling blade 64 curls. Additionally, it is possible that the leveling blade 64 becomes a source of vibration, and the lubrication device 6 vibrates, causing noise. It is to be noted that, if the leveling blade 64 curls, the friction coefficient between the photoconductor 1 and the leveling blade 64 rises further, and noise of the lubrication device 6 arising from the leveling blade 64 (i.e., the source of vibration) or noise of the image forming apparatus 1000 can increase.

It is possible that users feel uncomfortable with noise of the image forming apparatus 1000 caused by vibration of the leveling blade 64 that slidingly contacts the photoconductor 1.

Additionally, if lubricant is insufficient in a given area on the photoconductor 1, friction coefficient between the photoconductor 1 and a cleaning blade 5A of the cleaning device 5 rises, and photoconductor 1, the cleaning blade 5A, or both can vibrate and cause noise.

In view of the foregoing, an aim of the present embodiment is to provide a lubrication device capable of applying a preferable amount of lubricant and attaining high quality images while inhibiting noise caused by vibration of a blade that slidingly contacts the photoconductor 1.

Specifically, in the present embodiment, the vibration detector 65 detects the vibration of the lubrication device 6 that occurs from the blade that slidingly contacts the photoconductor 1 when lubricant is insufficient, and the detected vibration is used as the variable to control the rotational frequency R of the brush driving motor 7.

Next, descriptions are given below of control of the rotational frequency R of the brush driving motor 7 in which the leveling blade 64 serves as the blade (i.e., the source of vibration) that slidingly contacts the photoconductor 1.

As shown in FIG. 7, the lubrication device 6 according to the third embodiment includes the vibration detector 65 in addition to the components of the lubrication device 6 according to the first or second embodiment. The vibration detector 65 detects vibration of a blade holder that holds the leveling blade 64. With the vibration detector 65, vibration of the lubrication device 6 at the blade holder is detected (the leveling blade 64 is the source of vibration). According to a vibration value, which is the degree of vibration detected, the controller 8 controls the rotational frequency R of the brush driving motor 7 to drive the brush roller 62.

The following effects are available by controlling the rotational frequency R of the brush driving motor 7 using the vibration value. Even when the image area ratio is high locally in the image formation area of the photoconductor 1, a preferable amount of lubricant can be applied while inhibiting noise caused by vibration of the lubrication device 6 arising from the leveling blade 64 to level the lubricant on the photoconductor 1.

For example, the vibration detector 65 is attached to the blade holder to hold the leveling blade 64 and monitors the vibration thereof. When the detected vibration value reaches a predetermined value or greater, the rotational frequency R of the brush driving motor 7 is switched to increase the amount of lubricant applied to the photoconductor 1.

That is, the controller 8 controls the brush driving motor 7 to increase the frequency of rotation of the brush roller 62 as a peak vibration value A output from the vibration detector 65 increases.

With this control, increases in frictional resistance between the photoconductor 1 and the leveling blade 64 are inhibited, and the occurrence of noise caused by vibration of the lubrication device 6 arising from the leveling blade 64 can be inhibited. Even when the noise occurs, the volume thereof is reduced.

As shown in FIG. 8, the controller 8 according to the present embodiment determines the rotational frequency R of the brush driving motor 7 according to the peak vibration value A output from the vibration detector 65 using thresholds.

In the configuration shown in FIG. 8, when the peak vibration value A is less than a first threshold $A_1$, the rotational frequency R of the brush driving motor 7 is set to $R_{def}$. When the peak vibration value A is at or greater than the first threshold $A_1$ and less than a second threshold $A_2$, the rotational frequency R of the brush driving motor 7 is set to $R_1$. When the peak vibration value A is at or greater than the second threshold $A_2$, the rotational frequency R of the brush driving motor 7 is set to $R_2$.

Thus, the peak vibration thresholds and settings of the rotational frequencies R corresponding to the peak vibration thresholds are defined. Accordingly, the amount of lubricant applied can correspond to the degree of vibration of the lubrication device 6 arising from the leveling blade 64, in particular, the vibration value detected at the blade holder. Simultaneously, the occurrence of noise caused by vibration of the lubrication device 6 is inhibited, or the volume of noise is reduced.

It is to be noted that, although two thresholds (the first and second threshold $A_1$ and $A_2$) of the peak vibration value A are used in the example shown in FIG. 8, the number of thresholds is not limited thereto.

For example, the number of thresholds of the peak vibration value A can be three or greater. In this case, the rotational frequency R of the brush driving motor 7 is controlled more sensitively according to the vibration value detected at the blade holder of the lubrication device 6 and arising from the leveling blade 64 of the lubrication device 6.

It is to be noted that, when an accelerometer is used as the vibration detector 65, the peak vibration value A can be an acceleration of frequency that is highest among frequency components detected by the vibration detector 65 as shown in FIG. 9.

Additionally, the location of the vibration detector 65 to detect the vibration whose source is the leveling blade 64 and the position at which the vibration is detected are not limited to the blade holder to hold the leveling blade 64. For example, the vibration detector 65 may be provided to a casing of the lubrication device 6 and a detection position of the vibration detector 65 may be set at a position where the vibration arising from the leveling blade 64 is greater. In other words, the vibration detector 65 can be disposed arbitrarily as long as changes in vibration of the leveling blade 64 due to shortage of lubricant are detected before the vibration increases to a degree to damage the photoconductor 1, cause the leveling blade 64 to curl, or cause noisy noise that makes the user uncomfortable.

Additionally, the source of vibration detected is not limited to the leveling blade 64. Alternatively, for example, the vibration detector 65 may detect vibration of the lubrication device 6 arising from the cleaning blade 5A of the cleaning device 5.

Specifically, when lubricant is insufficient locally on the photoconductor 1, it is possible that the cleaning blade 5A of the cleaning device 5 vibrates. Accordingly, the vibration arising from the cleaning blade 5A is detected and used to control the rotational frequency R of the brush driving motor 7.

There are following routes through which the vibration of the cleaning blade 5A propagates. In the configuration includes the leveling blade 64 shown in FIG. 7, the vibration of the cleaning blade 5A can propagate through the photoconductor 1, through a casing of the process cartridge (the image forming unit 10), or through a frame of the apparatus body 100.

Additionally, regardless of the presence of the leveling blade 64, in the configuration in which the cleaning device 5 and the lubrication device 6 are integrated together, the vibration can propagate also through a casing that holds the cleaning device 5 and the lubrication device 6.

Also in a configuration in which the cleaning device 5 is separate from the lubrication device 6 and the leveling blade 64 is not provided, the vibration can propagate through the casing of the process cartridge or the frame of the apparatus body 100. Additionally, the vibration can propagate due to resonance between the casing of the lubrication device 6 and the cleaning device 5.

Also in this case, the vibration detector 65 can be disposed arbitrarily as long as changes in vibration are detected before the vibration increases to a degree to damage the photoconductor 1, cause the leveling blade 64 or the cleaning blade 5A to curl, or cause noisy noise that makes the user uncomfortable.

In the description above, the rotational frequency R of the brush driving motor 7 is controlled according to a single variable, that is, the vibration value of the lubrication device 6, detected by the vibration detector 65. Alternatively, multiple variables may be used to determine the rotational frequency R of the brush driving motor 7. For example, the rotational frequency R of the brush driving motor 7 may be controlled according to a combination of the vibration value and the mean image area ratio, the image area ratio of the divided range, or both, used in the control operation according to the first and second embodiments.

When the multiple variables are used in combination, a more preferable amount of lubricant can be applied to the photoconductor 1.

In either case, as described in the first and second embodiments, switching the rotational frequency R of the brush driving motor 7 during idle running of the photoconductor 1 is advantageous in inhibiting the occurrence of image failure, such as banding, caused by the switching of the rotational frequency R.

(Fourth Embodiment)

The lubrication device 6 according to a fourth embodiment is described below.

Figure 10:
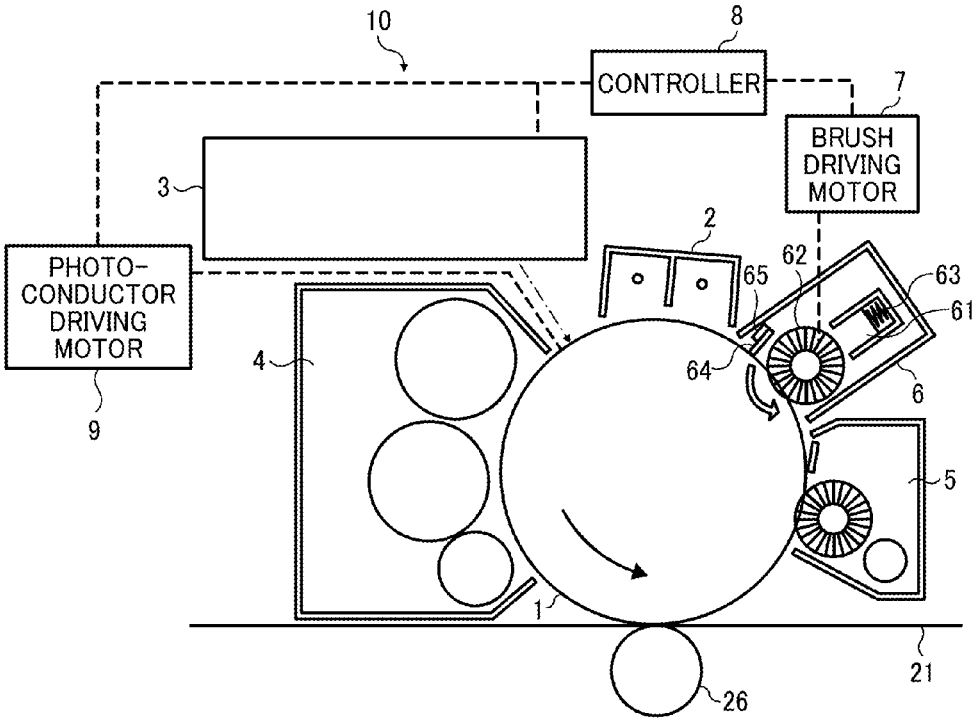
FIG. 10 is an enlarged view illustrating a configuration of an image forming unit according to a fourth embodiment.
Figure 11:
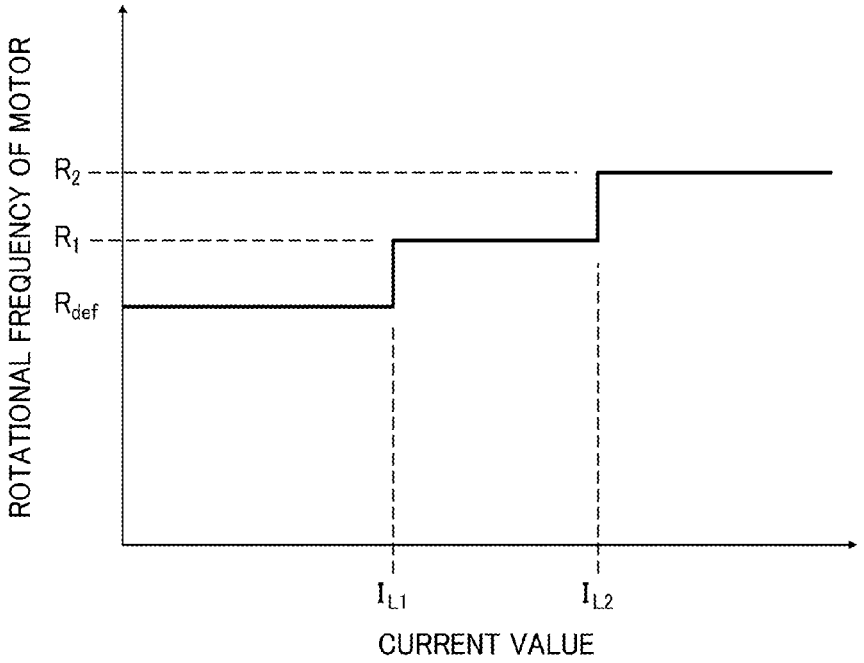
FIG. 11 is a graph illustrating the relation between a current value of a photoconductor driving motor and the rotational frequency of the brush driving motor according to the fourth embodiment.

FIG. 10 is an enlarged view illustrating a configuration of the image forming unit 10 according to the present embodiment. FIG. 11 is a graph illustrating the relation between an electrical current (i.e., a current value $I_L$) of a photoconductor driving motor 9 and the rotational frequency R of the brush driving motor 7.

The lubrication device 6 according to the present embodiment is different from those of the above-described first, second, and third embodiments in the predetermined variable used to control the rotational frequency R of the brush driving motor 7. Specifically, the mean image area ratio or the image area ratio of the divided range is used as the predetermined variable in the first and second embodiments, and the detected value of vibration of the lubrication device 6 is used in the third embodiment. By contrast, in the lubrication device 6 according to the present embodiment, the current value $I_L$ of the photoconductor driving motor 9 to drive the photoconductor 1 is used.

Accordingly, descriptions about configurations, operation, action, and effects of the present embodiment similar to those of the first, second, or third embodiment are omitted. Components identical or similar to those described above are given identical reference characters.

As described in the second embodiment, when the mean image area ratio is used as in the first embodiment, for example, in the case shown in FIG. 6A, in which the image area ratio is low entirely but is high locally, there is a risk of shortage of lubricant. In other words, there is a risk of shortage of lubricant in a case of a toner image having ranges different in image area ratio.

If printing is repeatedly performed in a state in which lubricant is locally insufficient as described above, the friction force increases between the photoconductor 1 and the leveling blade 64, and torque to drive the photoconductor 1 increases. If this state continues, it is possible that the photoconductor driving motor 9 shown in FIG. 10 fails to stably drive the photoconductor 1. As a result, it is possible that printing position deviates, or the printing operation is aborted.

In view of the foregoing, in the present embodiment, the photoconductor driving motor 9 is connected to the controller 8 as shown in FIG. 10 so that the controller 8 detects the electrical current (the current value $I_L$) that flows to the photoconductor driving motor 9. The controller 8 controls the brush driving motor 7 to keep the current value $I_L$ of the photoconductor driving motor 9 at or lower than a threshold. In particular, the controller 8 changes the rotational frequency R of the brush driving motor 7 to keep the current value $I_L$ of the photoconductor driving motor 9 at or lower than the threshold. This operation enables application of a preferable amount of lubricant as described below.

In the case of motors such as direct-current (DC) motors, which are widely used as the photoconductor driving motor 9, typically, the current value $I_L$ of the motor increases as the torque to drive the motor increases. Herein, a current value $I_{L0}$ represents the amount of electrical current of the photoconductor driving motor 9 when the preferable amount of lubricant is applied to the photoconductor 1. A preferable amount of lubricant can be applied to the photoconductor 1 by adjusting the rotational frequency R of the brush driving motor 7 to keep the current value $I_L$ of the photoconductor driving motor 9 at or lower than the current value $I_{L0}$.

Specifically, in the present embodiment, as shown in FIG. 11, the rotational frequency R of the brush driving motor 7 is determined according to the current value $I_L$ of the photoconductor driving motor 9.

In the case shown in FIG. 11, when the current value $I_L$ is less than a first threshold $I_{L1}$, the rotational frequency setting of the brush driving motor 7 is $R_{def}$. When the current value $I_L$ is at or greater than the first threshold $I_{L1}$ and less than a second threshold $I_{L2}$, the rotational frequency setting of the brush driving motor 7 is $R_1$. When the current value $I_L$ is at or greater than the second threshold $I_{L2}$, the rotational frequency setting of the brush driving motor 7 is $R_2$.

By defining the thresholds of the current value $I_L$ of the photoconductor driving motor 9 and changing the rotational frequency setting of the brush driving motor 7 according to the current value $I_L$, the photoconductor 1 is lubricated preferably.

Thus, in the present embodiment, the controller 8 controls the brush driving motor 7, in particular, changes the rotational frequency R thereof, in accordance with the current value $I_L$ of the photoconductor driving motor 9 that drives the photoconductor 1. With this control operation, even when the image area ratio is high locally in the image formation area of the photoconductor 1, the amount of lubricant applied to the photoconductor 1 is suitable for reducing the friction force between the photoconductor 1 and the leveling blade 64 to level the lubricant on the photoconductor 1.

The controller 8 controls the brush driving motor 7 to increase the frequency of rotation of the brush roller 62 as the current value $I_L$ of the photoconductor driving motor 9 increases. This control operation preferably inhibits increases in the friction force between the photoconductor 1 and the leveling blade 64 that slidingly contacts the photoconductor 1.

In the description above, the rotational frequency R of the brush driving motor 7 is controlled according to a single variable, that is, the current value $I_L$ of the photoconductor driving motor 9. Alternatively, multiple variables may be used in combination to determine the rotational frequency R of the brush driving motor 7, similar to the above-described third embodiment.

(Fifth Embodiment)

The lubrication device 6 according to a fifth embodiment is described below.

Figure 12:
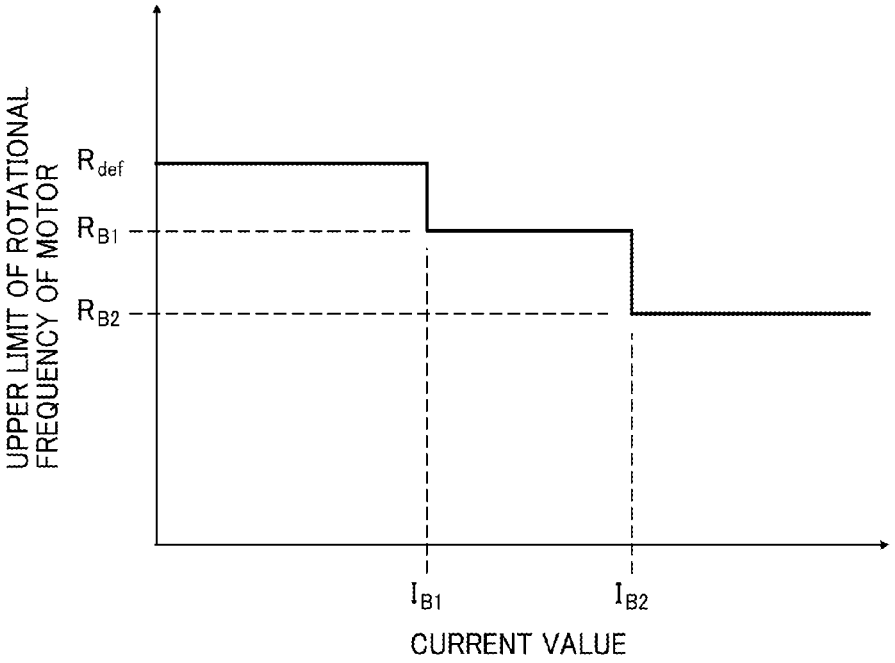
FIG. 12 is a graph illustrating the relation between a current value of the brush driving motor and an upper limit of the rotational frequency of the brush driving motor according to a fifth embodiment.

FIG. 12 is a graph illustrating the relation between a current value $I_B$ of the brush driving motor 7 and settings of an upper limit $R_{UL}$ of the rotational frequency R of the brush driving motor 7.

Configurations of the image forming unit 10 and adjacent portions according to the fifth embodiment are similar to those of the fourth embodiment and described using FIG. 10 that illustrates the configurations of the fourth embodiment.

The lubrication device 6 according to the present embodiment is different from those of the above-described first, second, third, and fourth embodiments in the predetermined variable used to control the rotational frequency R of the brush driving motor 7. Specifically, the mean image area ratio or the image area ratio of the divided range is used as the predetermined variable in the first and second embodiments, and the detected value of vibration of the lubrication device 6 is used in the third embodiment. In the lubrication device 6 according to the fourth embodiment, the current value $I_L$ of the photoconductor driving motor 9 is used. By contrast, in the present embodiment, the current value $I_B$ of the brush driving motor 7, serving as the applicator driving device, is used singly or in combination with other variables to control the rotational frequency R of the brush driving motor 7.

Accordingly, descriptions about configurations, operation, action, and effects of the present embodiment similar to those of the first, second, third, or fourth embodiment are omitted. Components identical or similar to those described above are given identical reference characters.

In electrophotographic image forming apparatuses, such as the image forming apparatus 1000 shown in FIG. 1, that includes the lubrication device to lubricate the image bearer, typically printing operation is stopped when the driving device (hereinafter "applicator driving device") to drive the applicator (such as an application brush) is subjected to a load greater than a predetermined torque (i.e., a rated torque) for a long time. Image formation is automatically stopped and the apparatus is stopped when the applicator driving device is kept under a load greater than the predetermined torque from the following reason.

When image formation (printing operation) is repeatedly performed, it is possible that the load to drive the applicator such as an application brush increases due to toner entering the lubrication device, wear of the driving device, or the like. If the state in which the driving torque is large continues, for example, the applicator driving device is subjected to a load greater than the rated load thereof, and the applicator driving device may be abruptly damaged or fail to operate reliably.

Work and cost to replace the damaged applicator driving device cause inconveniences for users. Additionally, replacement results in downtime of the image forming apparatus.

Additionally, if unreliable driving of the applicator driving device continues, the occurrence of image failure increases. Additionally, it is possible that the operational life of the lubrication device or the image bearer to be lubricated, thus reducing the operational life of the image forming apparatus itself.

To inhibit such inconveniences, there are many image forming apparatuses that stop image formation automatically when the applicator driving device is kept under the load greater than the predetermined torque.

Wear of the driving device is described below.

In the case of the image forming apparatus 1000 shown in FIG. 1, driving device components that wear include a bearing via which a rotation shaft of the brush roller 62 is rotatably supported by the casing of the lubrication device 6 and a seal member to inhibit toner from entering the bearing. Additionally, since the brush driving motor 7 also drives the cleaning brush and the conveying screw of the cleaning device 5, a train of gears is used to decelerate and transmit rotational driving force to those components, and such gears wear.

When the bearing (a sliding contact portion thereof in particular) wears with time, looseness is caused, resulting in increases in rotation resistance of the bearing, that is, the driving torque applied to the brush driving motor 7 when the brush roller 62 is driven. When the seal member wears with time, clearance arises between the rotation shaft of the brush roller 62 and the seal member. Then, it is possible that toner entering, via the brush roller 62, the casing of the lubrication device 6 enters the sliding contact portion of the bearing and accelerate the wear of the bearing. As a result, the driving torque applied to the brush driving motor 7 increases further.

Additionally, when sliding contact portions of the gears wear with time, mesh of the gears is loosened, resulting in increases in transmission resistance of the gears, that is, the driving torque applied to the brush driving motor 7 when the brush roller 62 is driven.

If the load greater than the rated torque causes the image forming apparatus to stop and be restarted after maintenance work, aborted printing jobs are suspended during the maintenance work. Even if there are urgent printing jobs, the apparatus is not feasible during the maintenance work. Thus, downtime is caused.

In view of the foregoing, in the present embodiment, the brush driving motor 7 is connected to the controller 8 as shown in FIG. 10 so that the controller 8 detects the current value $I_B$ that flows to the brush driving motor 7, thereby detecting the driving torque applied to the brush driving motor 7.

The controller 8 controls the brush driving motor 7 to keep the current value $I_B$ of the brush driving motor 7 at or lower than a threshold. In particular, the controller 8 changes the upper limit $R_{UL}$ of an adjustable range of the rotational frequency R of the brush driving motor 7.

The threshold of the current value $I_B$ is set to correspond to the rotational frequency R of the brush driving motor 7 to secure reliable operation of the brush driving motor 7 and inhibit the occurrence of image failure resulting from shortage of lubricant even if printing operation in continued for a predetermined number of sheets.

This control can inhibit the occurrence of image failure while inhibiting the stop of the image forming apparatus 1000 due to continuous application of the driving load greater than the predetermined load (or rated load) to the brush driving motor 7. Significant degradation of user conveniences is inhibited by inhibiting the stop of the image forming apparatus 1000.

When the upper limit $R_{UL}$ of the rotational frequency R is lowered, the frequency of rotation of the brush roller 62 decreases, and there are risks of shortage of lubricant applied to the photoconductor 1 per unit time. Additionally, limitations may be imposed on the rotational frequency R of the brush driving motor 7 determined by another variable used in combination.

However, the rotational frequency R of the brush driving motor 7 is changed during idle running of the photoconductor 1. Accordingly, shortage of lubricant can be compensated as follows. At the timing at which the upper limit $R_{UL}$ of the rotational frequency R is changed to a subsequent upper limit setting, the photoconductor 1 runs idle using the subsequent upper limit setting without image formation. While the photoconductor runs idle, lubricant is applied to the photoconductor 1 to make up for the shortage that occurs in the subsequent image formation using the subsequent upper limit setting of the upper limit $R_{UL}$, on the predetermined number of sheets.

This control can inhibit the occurrence of image failure while inhibiting the stop of the image forming apparatus 1000 due to continuous application of the driving load greater than the predetermined load (or rated load) to the brush driving motor 7. Significant degradation of user conveniences is inhibited by inhibiting the stop of the image forming apparatus 1000.

It is to be noted that inhibition of stop of the image forming apparatus described above can prolong the operational life of the lubrication device 6 but does not resolve the inconvenience undergoing. Accordingly, to solve the undergoing inconvenience of the lubrication device 6, in the image forming apparatus 1000 according to the present embodiment, when the upper limit $R_{UL}$ of the rotational frequency R is lowered, an alert appears on a display part of a control panel to prompt the user to replace the lubrication device 6.

Next, descriptions are given below of an operation of the controller 8 to control the brush driving motor 7 according to the present embodiment.

For example, as shown in FIG. 12, the controller 8 determines the upper limit $R_{UL}$ of the range within which the rotational frequency R of the brush driving motor 7 is changed in accordance with the threshold of the current value $I_B$ output from the brush driving motor 7.

In the example shown in FIG. 12, three settings ($R_{def}$, $R_{B1}$, and $R_{B2}$) are used as the upper limit $R_{UL}$ of the rotational frequency R. When the current value $I_B$ is less than a first threshold $I_{B1}$, the upper limit setting of the rotational frequency R is $R_{def}$. When the current value $I_B$ is at or greater than the first threshold $I_{B1}$ and less than a second threshold $I_{B2}$, the upper limit setting of the rotational frequency R is $R_{B1}$. When the current value $I_B$ is greater than the second threshold $I_{B2}$, the upper limit setting of the rotational frequency R is $R_{B2}$.

By defining the upper limit $R_{UL}$ of the rotational frequency R of the brush driving motor 7, the rotational frequency R can be set to a preferable value to prevent the driving load of the brush driving motor 7 from exceeding the rated torque, and the brush driving motor 7 can operate reliably, corresponding to the current value $I_B$ of the brush driving motor 7.

That is, as the current value $I_B$ output from the brush driving motor 7 increases, the controller 8 reduces stepwise the upper limit setting of the rotational frequency R from $R_{def}$ to $R_{B1}$ and further to $R_{B2}$, thereby maintaining a reliable driving of the brush driving motor 7.

This control can inhibit the occurrence of image failure while better inhibiting the stop of the image forming apparatus 1000 due to continuous application of the driving load greater than the predetermined load (or rated load) to the brush driving motor 7. Then, significant degradation of user conveniences caused by the stop of the image forming apparatus 1000 is better inhibited.

It is to be noted that the number of thresholds of the current value $I_B$ and the number of settings of the upper limit $R_{UL}$ are not limited to those shown in FIG. 12. Alternatively, for example, the upper limit $R_{UL}$ of the rotational frequency R may be changed in two steps, four steps, or five steps.

Additionally, to resolve the shortage of the amount of lubricant applied to the photoconductor 1 per unit time caused by the decrease in the upper limit $R_{UL}$ an image formation speed may be reduced.

The reduction in image formation speed decreases the speed at which the surface of the photoconductor 1 moves, thereby increasing the amount of lubricant applied to the photoconductor 1 per unit time.

Therefore, the occurrence of image failure is inhibited while better inhibiting the stop of the image forming apparatus 1000 due to continuous application of the driving load greater than the predetermined load (or rated load) to the brush driving motor 7. Thus, significant degradation of user conveniences is inhibited by inhibiting the stop of the image forming apparatus 1000.

Specifically, the following control operation is performed.

Initially, descriptions are given below of a case in which the current value $I_B$ of the brush driving motor 7 is used singly as the predetermined variable to control the rotational frequency R of the brush driving motor 7.

In accordance with the rate of deceleration of the brush driving motor 7 to prevent the driving load greater than the rated load applied to the brush driving motor 7, linear velocities of the photoconductor 1, the intermediate transfer belt 21, the fixing belt 31, and the pressure roller 32 are reduced. Further, in accordance with the rate of such deceleration, speed of exposure by the optical writing unit 3 is reduced; timings at which optical writing is started, respective bias applications are started and stopped, rotation of the registration rollers 47 is started are changed; and velocity of the registration rollers 47 is changed.

Next, descriptions are given below of a case in which the current value $I_B$ of the brush driving motor 7 is used in combination with another variable.

In a case in which the current value $I_L$ of the photoconductor driving motor 9, described in the fourth embodiment, is used in combination, when the current value $I_L$ detected is within a range from the first threshold $I_{L1}$ to the second threshold $I_{L2}$, the setting of the rotational frequency R of the brush driving motor 7 is $R_1$. At that time, if the current value $I_B$ is greater than the second threshold $I_{B2}$, the upper limit $R_{UL}$ of the rotational frequency R is set to $R_{B2}$.

Here, it is assumed that the setting of the rotational frequency R ($R_{def}$, $R_1$, or $R_2$ shown in FIG. 11) of the brush driving motor 7 derived from the current value $I_L$ of the photoconductor driving motor 9 is identical to the upper limit setting ($R_{B2}$, $R_{B1}$, or $R_{def}$ shown in FIG. 12) of the rotational frequency R derived from the current value $I_B$ of the brush driving motor 7.

Then, the rotational frequency setting $R_1$, shown in FIG. 11, derived from the current value $I_L$ of the photoconductor driving motor 9 is regulated by the upper limit setting $R_{B2}$ in FIG. 12, which is identical to $R_{def}$ shown in FIG. 11. Thus, the rotational frequency setting $R_{def}$ (in FIG. 11) is used in the control operation. That is, the rotational frequency setting $R_1$, which is to attain a required application amount of lubricant on the photoconductor 1, is lowered to the rotational frequency setting $R_{def}$.

Accordingly, in this case, in accordance with the rate of deceleration of the rotational frequency setting $R_1$ and the rotational frequency setting $R_{def}$, the linear velocities of the photoconductor 1, the intermediate transfer belt 21, the fixing belt 31, and the pressure roller 32 are reduced. Further, in accordance with the rate of such deceleration, speed of exposure by the optical writing unit 3 is reduced; timings at which optical writing is started, respective bias applications are started and stopped, rotation of the registration rollers 47 is started are changed; and velocity of the registration rollers 47 is changed.

In the two cases described above, the reduction in image formation speed decreases the speed at which the surface of the photoconductor 1 moves, thereby increasing the amount of lubricant applied to the photoconductor 1 per unit time.

Therefore, the occurrence of image failure is inhibited while better inhibiting the stop of the image forming apparatus 1000 due to continuous application of the driving load greater than the predetermined load (or rated load) to the brush driving motor 7. Thus, significant degradation of user conveniences is inhibited by inhibiting the stop of the image forming apparatus 1000.

Although the descriptions above concern the placement in which the lubrication device 6 is situated downstream from the cleaning device 5 in the direction in which the photoconductor 1 rotates, embodiments of the present invention are not limited thereto. Alternatively, for example, the lubrication device 6 may be positioned upstream from the cleaning device 5 in the direction in which the photoconductor 1 rotates. The placement in which the lubrication device 6 is upstream from the cleaning device 5 is advantageous in that the cleaner can be used as the leveling blade 64 and accordingly the cost and the space are reduced.

The various aspects of the present specification can attain specific effects as follows.

(Aspect A)

In a lubrication device that includes a solid lubricant such as the solid lubricant 61, an applicator such as the brush roller 62 to apply lubricant scraped off from the solid lubricant to an image bearer such as the photoconductor 1 while rotating, an applicator driving device such as the brush driving motor 7 to rotate the applicator, and a controller such as the controller 8 to control the applicator driving device, the controller controls the applicator driving device to change a rotational frequency of the applicator during idle running of the image bearer.

With this configuration, as described in the above-described embodiments, even when rotation of the image bearer fluctuates due to the change in rotational frequency of the applicator, image formation is not affected since the rotational frequency of the applicator is changed while the image bearer runs idle. Thus, image failure such as banding is not caused.

Accordingly, this aspect can provide a lubrication device capable of attaining high quality images while inhibiting image failure.

(Aspect B)

In aspect A, according to the image area ratio of the toner image on the image bearer, such as the photoconductor 1, the controller controls the applicator driving device to change the rotational frequency of the applicator.

With this aspect, as described in the above-described embodiments, even when an excess or a shortage of lubricant is derived from differences in image area ratio of toner image, the amount of lubricant applied is adjusted preferably by changing the rotational frequency of the applicator.

(Aspect C)

In aspect B, the controller acquires the image area ratio of the toner image on the image bearer, such as the photoconductor 1, for each of multiple unit areas divided in the main scanning direction. The controller uses, as the predetermined variable, the image area ratio of at least one of the multiple unit areas on the image bearer, such as the photoconductor 1, divided in the main scanning direction.

With this aspect, as described in the above-described embodiments, the amount of lubricant applied is adjusted preferably even when the image area ratio is higher locally on the photoconductor 1.

(Aspect D)

In aspect C, the controller uses the highest among the respective image area ratios of the multiple unit areas to control the applicator driving device (such as the brush driving motor 7) to change the rotational frequency of the applicator (such as the brush roller 62).

With this configuration, as described in the above-described embodiments, even when the unit image area ratio is higher in a given portion on the image bearer, the preferable amount of lubricant can be applied to the image bearer. Simultaneously, calculation steps of the controller to control the applicator driving device can be simplified.

(Aspect E)

In any of aspects A through D, the lubrication device further includes a vibration detector such as the vibration detector 65 to detect the lubrication device. According to a vibration value, such as the peak vibration value A, detected by the vibration detector, the controller controls the applicator driving device such as the brush driving motor 7 to change the rotational frequency of the applicator such as the brush roller 62.

With this configuration, as described in the above-described embodiments, even when the image area ratio is high locally in the image formation area of the image bearer, a preferable amount of lubricant can be applied while inhibiting noise caused by vibration of the lubrication device arising from the leveling blade 64 to level the lubricant on the image bearer.

(Aspect F)

In aspect E, the controller controls the applicator driving device, such as the brush driving motor 7, to increase the frequency of rotation of the applicator, such as the brush roller 62, as the vibration value, such as the peak vibration value A, output from the vibration detector increases.

As described in the above-described embodiments, this aspect suppresses increases in the friction force between the image bearer, such as the photoconductor 1, and the blade, such as the leveling blade 64, that slidingly contacts the photoconductor 1.

Accordingly, while inhibiting the occurrence of noise caused by vibration of the lubrication device arising from the blade that slidingly contacts the image bearer, the volume can be reduced when the noise occurs.

(Aspect G)

In any of aspects A through F, the controller controls the applicator driving device, such as the brush driving motor 7, to change the rotational frequency of the applicator, such as the brush roller 62, according to a current value, such as the current value $I_L$, of the driving unit, such as the photoconductor driving motor 9, to drive the photoconductor 1.

With this configuration, as described in the above-described fourth and fifth embodiments, even when the image area ratio is high locally in the image formation area of the image bearer such as the photoconductor 1, the amount of lubricant applied to the image bearer is suitable for reducing the friction force between the image bearer and the blade such as the leveling blade 64 to level the lubricant on the image bearer.

(Aspect H)

In aspect G, the controller controls the applicator driving device, such as the brush driving motor 7, to increase the rotational frequency of the applicator, such as the brush roller 62, as the current value, such as the current value $I_L$, of the driving unit, such as the photoconductor driving motor 9, increases.

As described in the above-described fourth and fifth embodiments, this aspect suppresses increases in the friction force between the image bearer, such as the photoconductor 1, and the blade, such as the leveling blade 64, that slidingly contacts the photoconductor 1 image bearer.

(Aspect I)

In any of aspects B through H, the controller controls the applicator driving device (such as the brush driving motor 7) to increase the rotational frequency of the applicator (such as the brush roller 62) as the image area ratio of the toner image on the image bearer (such as the photoconductor 1) increases.

With this aspect, as described in the above-described embodiments, even when the image area ratio of toner images increases and the amount of lubricant on the image bearer becomes insufficient, the amount of lubricant applied is adjusted preferably by increasing the rotational frequency of the applicator.

(Aspect J)

In any of aspects A through I, the controller controls the applicator driving device to change the rotational frequency of the applicator (such as the brush roller 62) according to either the cumulative number of rotation or the cumulative driving time of the applicator.

With this aspect, as described in the above-described embodiments, even when the lubrication capability of the applicator changes as the cumulative number of rotation or the cumulative driving time of the applicator increases, the amount of lubricant applied is adjusted preferably by changing the rotational frequency of the applicator.

(Aspect K)

In aspect J, the controller controls the applicator driving device to increase the rotational frequency of the applicator (such as the brush roller 62) as the cumulative number of rotation or the cumulative driving time of the applicator increases.

With this aspect, as described in the above-described embodiments, even when the lubrication capability of the applicator decreases as the cumulative number of rotation or the cumulative driving time of the applicator increases, the amount of lubricant applied is adjusted preferably by increasing the rotational frequency of the applicator.

(Aspect L)

In any of aspects A through K, the controller changes the upper limit $R_{UL}$ of the rotational frequency R of the applicator driving device (such as the brush driving motor 7) among multiple settings (such as $R_{def}$, $R_{B1}$, and $R_{B2}$), thereby changing the upper limit of the rotational frequency of the applicator (such as the brush roller 62) according to a current value, such as the current value $I_B$, of the applicator driving device.

As described in the fifth embodiment, this aspect can inhibit the occurrence of image failure while inhibiting the stop of the image forming apparatus due to continuous application of the driving load greater than the predetermined load to the applicator driving device. Significant degradation of user conveniences is inhibited by inhibiting the stop of the image forming apparatus.

(Aspect M)

In aspect L, the controller lowers the upper limit $R_{UL}$ of the rotational frequency R of the applicator driving device, such as the brush driving motor 7, for example, from $R_{def}$ to $R_{B1}$ or from $R_{B1}$ to $R_{B2}$, as the current value, such as the current value $I_B$, output from the applicator driving device increases.

As described in the fifth embodiment, this aspect can inhibit image failure while more reliably inhibiting the stop of the image forming apparatus due to continuous application of the driving load greater than the predetermined load to the applicator driving device. Then, significant degradation of user conveniences caused by the stop of the image forming apparatus is better inhibited.

(Aspect N)

In an image forming apparatus that includes an image bearer such as the photoconductor 1, a toner image forming unit such as the image forming unit 10 to form a toner image on the image bearer, a transfer device such as the primary-transfer roller 26 to transfer the toner image from the image bearer onto a transfer medium, and a cleaning device such as the cleaning device 5 to remove untransferred toner from the image bearer, the lubrication device according to any one of aspects A through M is used to lubricate the image bearer.

With this aspect, as described in the above-described embodiments, the occurrence of image failure is inhibited and high-quality images are available since a preferable amount of lubricant is applied to the image bearer.

(Aspect O)

In an image forming apparatus that includes an image bearer such as the photoconductor 1, a toner image forming unit such as the image forming unit 10 to form a toner image on the image bearer, a transfer device such as the primary-transfer roller 26 to transfer the toner image from the image bearer onto a transfer medium, and a cleaning device such as the cleaning device 5 to remove untransferred toner from the image bearer, the lubrication device according to aspect L or M is used to lubricate the image bearer. Additionally, when the amount of lubricant applied to the image bearer per unit time becomes insufficient due to the change of the upper limit of the rotational frequency of the applicator such as the brush roller 62, the image formation speed is reduced.

As described in the fifth embodiment, the reduction in image formation speed decreases the speed at which the surface of the image bearer moves, thereby increasing the amount of lubricant applied to the image bearer per unit time.

Therefore, the occurrence of image failure is inhibited while better inhibiting the stop of the image forming apparatus due to continuous application of the driving load greater than the predetermined load to the applicator driving device. Thus, the image forming apparatus inhibits significant degradation of user conveniences by inhibiting the stop of the image forming apparatus.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

an image bearer;

a toner image forming unit to form a toner image on the image bearer;

a transfer device to transfer the toner image from the image bearer onto a transfer medium;

a cleaning device to remove untransferred toner from the image bearer;

an image bearer driving device; and a lubrication device to apply lubricant to the image bearer, the lubrication device including:

a solid lubricant, an applicator to apply lubricant scraped off from the solid lubricant to the image bearer while rotating, and an applicator driving device to rotate the applicator; and a controller to control the applicator driving device according to a set variable to change a rotational frequency of the applicator during idle running of the image bearer, wherein the applicator driving device and the image bearer driving device are independently controlled to adjust an amount of lubricant for a subsequent printing operation by changing the rotational frequency of the applicator.

2. The image forming apparatus according to claim 1, wherein the controller controls the applicator driving device according to an image area ratio of a toner image on the image bearer.

3. The image forming apparatus according to claim 2, wherein the controller controls the applicator driving device to increase the rotational frequency of the applicator as the image area ratio of the toner image on the image bearer increases.

4. The image forming apparatus according to claim 1, wherein the controller acquires the image area ratio for each of multiple unit areas on the image bearer divided in a main scanning direction, and the controller controls the applicator driving device according to the image area ratio of at least one of the multiple unit areas.

5. The image forming apparatus according to claim 4, wherein the controller controls the applicator driving device according to the image area ratio of one of the multiple unit areas having a highest image area ratio.

6. The image forming apparatus according to claim 1, further comprising a vibration detector to detect vibration of the lubrication device, wherein the controller controls the applicator driving device according to a vibration value detected by the vibration detector.

7. The image forming apparatus according to claim 6, wherein the controller controls the applicator driving device to increase the rotational frequency of the applicator as the vibration value output from the vibration detector increases.

8. The image forming apparatus according to claim 1, further comprising a driving device to drive the image bearer, wherein the controller acquires a current value of the driving device and controls the applicator driving device according to the current value.

9. The image forming apparatus according to claim 8, wherein the controller controls the applicator driving device to increase the rotational frequency of the applicator as the current value of the driving device increases.

10. The image forming apparatus according to claim 1, wherein the controller controls the applicator driving device to change the rotational frequency of the applicator according to one of a cumulative number of rotation of the applicator and a cumulative driving time of the applicator.

11. The image forming apparatus according to claim 10, wherein the controller controls the applicator driving device to increase the rotational frequency of the applicator in accordance with an increase in one of the cumulative number of rotation of the applicator and the cumulative driving time of the applicator.

12. The image forming apparatus according to claim 1, wherein the controller acquires a current value output from the applicator driving device and changes an upper limit of the rotational frequency of the applicator driving device according to the current value.

13. The image forming apparatus according to claim 12, wherein the controller controls the applicator driving device to lower an upper limit of the rotational frequency of the applicator as the current value output from the applicator driving device increases.

14. The image forming apparatus according to claim 13, wherein, when an amount of lubricant applied to the image bearer per unit time becomes insufficient due to a change in the upper limit of the rotational frequency of the applicator, the controller reduces image formation speed.

15. The image forming apparatus according to claim 1, wherein the set variable is at least one of a toner input amount and a lubrication capability.

16. A lubrication device comprising:

a solid lubricant;

an applicator to apply lubricant scraped off from the solid lubricant to an image bearer while rotating; and an applicator driving device to rotate the applicator, wherein a setting of the applicator driving device is changed according to a set variable to change a rotational frequency of the applicator during idle running of the image bearer, and wherein the applicator driving device and an image bearer driving device are independently controlled to adjust an amount of lubricant for a subsequent printing operation by changing the rotational frequency of the applicator.

17. The lubrication device according to claim 16, wherein the set variable is at least one of a toner input amount and a lubrication capability.

* * * * *